US011597071B2

(12) United States Patent
Schadow et al.

(10) Patent No.: US 11,597,071 B2
(45) Date of Patent: Mar. 7, 2023

(54) ELECTRONIC MODULE

(71) Applicant: Robert Bosch GmbH, Stuttgart (DE)

(72) Inventors: Joachim Schadow, Stuttgart (DE); Joern Stock, Leinfelden-Echterdingen (DE); Florian Esenwein, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 55 days.

(21) Appl. No.: 16/497,859

(22) PCT Filed: Feb. 28, 2018

(86) PCT No.: PCT/EP2018/054889
§ 371 (c)(1),
(2) Date: Nov. 7, 2019

(87) PCT Pub. No.: WO2018/177673
PCT Pub. Date: Oct. 4, 2018

(65) Prior Publication Data

US 2020/0094393 A1 Mar. 26, 2020

(30) Foreign Application Priority Data

Mar. 29, 2017 (DE) ..... 10 2017 205 313.5

(51) Int. Cl.
*B25F 5/02* (2006.01)

(52) U.S. Cl.
CPC ..... *B25F 5/02* (2013.01)

(58) Field of Classification Search
CPC ..... B25F 5/02
See application file for complete search history.

(56) References Cited

U.S. PATENT DOCUMENTS 5,313,712 A * 5/1994 Curameng ..... G01C 17/20 33/354
D449,009 S * 10/2001 Gardiner ..... D10/62
6,598,684 B2 * 7/2003 Watanabe ..... B25B 21/02 173/176
6,926,473 B2 * 8/2005 Luebke ..... B25F 5/00 408/16
8,274,273 B2 * 9/2012 Nguyen ..... G01R 1/0408 324/126

(Continued)

FOREIGN PATENT DOCUMENTS

CN 104659293 A 5/2015
CN 105939822 A 9/2016

(Continued)

OTHER PUBLICATIONS

International Search Report corresponding to PCT Application No. PCT/EP2018/054889, dated Jun. 22, 2018 (German and English language document) (7 pages).

*Primary Examiner* — Nathaniel C Chukwurah
*Assistant Examiner* — Lucas E. A. Palmer
(74) *Attorney, Agent, or Firm* — Maginot, Moore & Beck LLP

(57) ABSTRACT

An electronic module, in particular for a hand-held power tool, includes at least one electronic unit, at least one contacting unit which is provided to establish contact with an electric energy source and/or to transfer electronic data, and at least one cover unit. The contacting unit is mounted on one side of the electronic unit facing away from the cover unit.

20 Claims, 5 Drawing Sheets

(56) References Cited

U.S. PATENT DOCUMENTS 9,004,191 B2 * 4/2015 Muller ..... B25F 5/006 173/162.2
9,756,402 B2 * 9/2017 Stampfl ..... B23Q 17/00
9,802,299 B2 * 10/2017 Hung ..... B25B 23/147
2001/0052418 A1 * 12/2001 Wissmach ..... B25F 5/027 173/170
2003/0218469 A1 * 11/2003 Brazell ..... G01V 3/15 324/637
2004/0016058 A1 * 1/2004 Gardiner ..... G01C 17/00 7/119
2004/0182587 A1 * 9/2004 May ..... B25B 23/1405 173/2
2005/0000998 A1 * 1/2005 Grazioli ..... B25D 17/24 227/2
2005/0069391 A1 * 3/2005 Dils ..... G01V 3/15 408/16
2005/0104735 A1 * 5/2005 Luebke ..... G01R 1/06788 340/686.5
2005/0247460 A1 * 11/2005 Luebke ..... G01V 3/15 173/2
2005/0280393 A1 * 12/2005 Feldmann ..... B25F 5/00 320/114
2008/0196910 A1 * 8/2008 Radle ..... G01V 3/15 173/2
2014/0151079 A1 * 6/2014 Furui ..... H02J 7/00 173/46
2014/0240125 A1 * 8/2014 Burch ..... G06Q 10/06 340/539.13
2014/0259599 A1 * 9/2014 Glaspell ..... B25F 5/021 29/407.04
2015/0136433 A1 * 5/2015 Nitsche ..... B25D 11/005 173/2
2015/0209950 A1 * 7/2015 Lutz ..... B25F 5/02 173/20
2015/0209951 A1 * 7/2015 Lutz ..... B23Q 17/00 173/20
2016/0067859 A1 * 3/2016 Rejman ..... B25F 5/02 439/577
2016/0129540 A1 * 5/2016 Tiede ..... B23Q 11/0046 173/197
2016/0311094 A1 * 10/2016 Mergener ..... B25B 23/1475
2016/0342151 A1 * 11/2016 Dey, IV ..... G05B 19/4155
2017/0083014 A1 * 3/2017 Conrad ..... G05B 19/425
2017/0173768 A1 * 6/2017 Dey, IV ..... B25B 23/1475
2018/0345474 A1 * 12/2018 Brennenstuhl ..... B25F 5/02

FOREIGN PATENT DOCUMENTS

CN 106457551 A 2/2017
DE 10 2014 225 332 A1 6/2016
JP H07-113864 A 5/1995
JP 2008-277096 A 11/2008
WO 2013/014914 A2 1/2013
WO 2016/096301 A1 6/2016

* cited by examiner

ELECTRONIC MODULE

This application is a 35 U.S.C. § 371 National Stage Application of PCT/EP2018/054889, filed on Feb. 28, 2018, which claims the benefit of priority to Serial No. DE 10 2017 205 313.5, filed on Mar. 29, 2017 in Germany, the disclosure of which is incorporated herein by reference in its entirety.

BACKGROUND

There are already known electronic modules, in particular for hand-held power tools, having at least one electronic unit, having at least one contacting unit, which is designed to contact an electrical energy source, and having at least one cover unit.

SUMMARY

The disclosure is based on an electronic module, in particular for a hand-held power tool, having at least one electronic unit, having at least one contacting unit, which is designed to contact an electrical energy source and/or to transmit electronic data, and having at least one cover unit.

It is proposed that the contacting unit be provided on a side of the electronic unit that faces away from the cover unit. This makes it possible, advantageously, to provide an electronic module that can be used in a flexible manner and that can be connected, by means of the contacting unit, to a multiplicity of devices. Advantageously, an exchangeable electronic module can be provided.

"Designed" is to be understood to mean, in particular, configured and/or equipped. That an object is designed for a particular function, is to be understood to mean, in particular, that the object fulfils and/or executes this particular function in at least one application state and/or operating state.

Preferably, the electronic module, in particular the electronic unit, has at least one transistor, particularly preferably at least one microprocessor. Particularly preferably, the electronic module, in particular the electronic unit, has at least one computing unit. A "computing unit" is to be understood to mean, in particular a unit having an information input, an information processing system, and an information output. Advantageously, the computing unit has at least one processor, a memory, input and output means, further electrical components, an operating program, closed-loop control routines, open-loop control routines and/or calculation routines. Preferably, the components of the computing unit are arranged on a common printed circuit board, in particular of the electronic unit, and/or, advantageously, arranged in a common housing. Preferably, the electronic module has at least one sensor unit, for sensing an operator-specific characteristic and/or a characteristic that is specific to a hand-held power tool. The characteristic quantity that is specific to a hand-held power tool may be, for example, a time of utilization, a utilization period, a utilization count, a utilization location, a utilization intensity, in particular a utilization load, preferably a utilization wear, a utilization state, an electric-current characteristic, a voltage characteristic, a rotational speed, an acceleration, in particular a vibration, a power, an orientation, a switch-on count, a switch-off count, an object-internal run time, attrition of components and/or the like, and, in particular, triggering of a safety function such as, for example, a kickback protective function, an item number, a serial number, a machine identification, logistics data, or the like. The operator-specific characteristic may be realized, for example, as operator pressing force, as operator advance force, as operator training status, as operator holding force, as operator-specific load type, as operator application, as operator pressure, as operator utilization factor such as, for example, a characteristic describing frequent utilization or infrequent utilization, as an operator utilization period, as an operator stress exposure such as, for example, a noise exposure and/or a vibration exposure, as operator access authorization to a location, as vital characteristic values of an operator, and/or as another operator-specific characteristic that is considered appropriate by persons skilled in the art. A "sensor unit" in this context is to be understood to mean, in particular, a unit designed to record at least one characteristic and/or one physical property, wherein the recording may be effected actively, such as, in particular, by the generating and emitting of an electrical measuring signal, and/or passively, such as, in particular, by sensing of changes in properties of a sensor components.

Preferably, the electronic module, in particular the electronic unit, has at least one output unit, for outputting at least one item of optical, acoustic and/or haptic information. Preferably, the output unit has at least one light-emitting diode, an indicator panel, a display, a buzzer, a loudspeaker, a vibration element, and/or a further output element that is considered appropriate by persons skilled in the art.

Preferably, the electronic module, in particular the electronic unit, has at least one input unit, in particular a switch, a button, a touch-sensitive and/or proximity-sensitive surface, a microphone, or a further operating element that is considered appropriate by persons skilled in the art.

Preferably, the electronic module, in particular the electronic unit, has at least one communication unit, in particular an NFC communication unit, for wired and/or wireless data transmission, in particular with a hand-held power tool. Preferably, the communication unit is realized as a send and/or receive unit for transmitting electronic data. The electronic module preferably has at least transmit and/or receive units or information units, in particular at least one NFC transmit and/or receive unit and a Bluetooth transmit and/or receive unit. Alternatively or additionally, the electronic module comprises at least one or more information unit(s), such as, for example, a QR code, a data matrix code, or the like. Preferably, at least one of the at least two transmit and/or receive units, in particular an NFC transmit and/or receive unit, is designed to rapidly establish a connection between the electronic module and an external unit, in particular the hand-held power tool. Preferably, at least one of the at least transmit and/or receive units, in particular a Bluetooth transmit and/or receive unit, is designed to transmit data, in particular to transmit a multiplicity of data in a short timespan, between the electronic module and an external unit, in particular the hand-held power tool. Preferably, the electronic module comprises at least one interface, in particular a wireless interface, for exchanging data with at least one external unit, in particular the hand-held power tool, a gateway, a smartphone, a data processing device, or the like. Preferably, an antenna of the communication unit is arranged on the electronic module in such a manner that a main radiation direction of the antenna can be in the direction of the cover unit.

It is additionally conceivable the electronic module, alternatively or additionally, has at least one energy harvesting unit, which is designed to convert mechanical energy and/or thermal energy into electrical energy. For example, it is conceivable for the energy harvesting unit to be designed to convert electrical energy from an ambient temperature, from vibrations, from air currents, or the like.

A "hand-held power tool" is to be understood to mean, in particular, a power tool for performing work on workpieces, but advantageously a power drill, hammer drill and/or percussion hammer, saw, plane, screwdriver, router, abrasive cutter, angle grinder, cutting tool, tile cutter, garden appliance and/or multifunction tool, that can be transported by an operator without the use of a transport machine. Preferably, the electronic module can be mechanically and/or electrically connected to the hand-held power tool; in particular, the electronic module can be arranged on the hand-held power tool by means of a, preferably detachable, holding mechanism. A hand-held power tool has a mass, in particular, that is less than 40 kg, preferably less than 10 kg, and particularly preferably less than 5 kg. It is additionally conceivable for the communication unit to be designed to exchange data with an external device such as, for example, a smartphone, a tablet, a PC and/or similar, in particular for the purpose of controlling the electronic module, upgrading firmware, reading-out the electronic module, or for a further function considered appropriate by persons skilled in the art. Preferably, a system comprising the electronic module has at least one shielding element, in particular a plastic plate or a spacing element, which is designed to decouple and/or shield the electronic module from thermal and/or mechanical influences. It is additionally conceivable that, for the purpose of increasing and/or damping a radiated transmission power of the communication unit, the electronic module has at least one reflection element, in particular a plastic plate, which is designed to reflect an electromagnetic radiation that is incident upon the reflection element, to concentrate said radiation and/or to enable a preferred propagation of an emitted radiation. The reflection element and/or the shielding element have/has a maximum thickness that, in particular, is less than 15 mm, preferably less than 10 mm, and particularly preferably less than 5 mm. Advantageously, the reflection element and/or the shielding element have/has a maximum thickness that, in particular, corresponds to a value from a value range of from 1 mm to 10 mm, preferably to a value from a value range of from 1 mm to 6 mm, and particularly preferably to a value from a value range of from 2 mm to 3 mm. Preferably, the reflection element and/or the shielding element are/is arranged between an outer surface of the housing, in particular an outer surface of the base, of the electronic module, and at least one antenna element of the communication unit of the electronic module.

Furthermore, it is conceivable for the electronic module, in particular the electronic unit, to be designed to sense an operating time of a connected hand-held power tool. The operating time can be read-out of the electronic module, in particular, for the purpose of accounting according to a pay-per-use model. It is additionally conceivable that the electronic module can be used as an electronic key that is required for operation of the hand-held power tool. For example, the hand-held power tool can be used only after the correct electronic module has been connected, e.g. when a switch-on lock-out of the hand-held power tool is cancelled following connection of the correct electronic module. In addition, it is conceivable for the electronic module to sense further parameters and operating data of a connected hand-held power tool, such as, for example, motor temperatures, total operating hours, tools used, position, orientation and/or location of the hand-held power tool, acceleration and/or shaking of the hand-held power tool, as well as further characteristics of the hand-held power tool that are considered appropriate by persons skilled in the art.

Furthermore, it is conceivable for application-specific information and/or information specific to a hand-held power tool to be stored in the electronic module. Based on the application-specific information and/or information specific to the hand-held power tool, the electronic module may output instructions and/or prompts to a user, in dependence on a use of the hand-held power tool. For example, it is conceivable that, by means of an input unit, or by means of data transmission to a communication unit, a task that is to be preformed is communicated to the electronic module by a user, and the electronic module thereupon proposes a suitable tool, in particular a hand-held power tool, for the task to be performed. Furthermore, it is conceivable that the electronic module, independently of any communication with the hand-held power tool and/or an external unit, can acquire, process and/or store data that, for example after having been acquired, processed and/or stored by the electronic module itself, can be read-out, in particular by means of a wired and/or wireless data connection to a gateway, a read-out device, or the like.

A "contacting unit" is to be understood to mean, in particular, a unit that provides at least one interface, in particular a contacting element, for electrically contacting the electronic module, and/or for transmitting data, and/or for transmitting electrical energy for operating at least the electronic unit. It is conceivable for the contacting unit to be of a wired and/or wireless design. Preferably, the contacting unit is realized, at least partly, as an NFC unit, which is designed to transmit electrical energy, in particular wirelessly, for operating at least the electronic unit. Furthermore, it is conceivable for the contacting unit to be realized, at least partly, as a unit having a communication unit of the electronic module. Preferably, at least one contacting element is realized as a contact tab, a contact spring, a contact clip, or as another contacting element considered appropriate by persons skilled in the art.

A "cover unit" is to be understood to mean, in particular, a unit that covers at least one side of the electronic unit and/or of the contacting unit so as to protect it against contact, and/or that closes at least one opening, in particular at least one housing opening of a housing, in particular of a base unit, of the electronic module or of the housing of the hand-held power tool. Preferably, the cover unit has little static effect, with respect to a housing that at least partly accommodates the cover unit, since, in particular, the housing that at least partly accommodates the cover unit very largely performs a static function, and/or is designed to support forces acting upon the cover unit. Preferably, on a side that faces away from the electronic unit, the cover unit has a closed surface that, in particular, extends over the electronic unit and/or the contacting unit. Preferably, the input unit and/or the output unit are arranged, at least partly, on the cover unit, in particular on a side of the cover unit that faces away from the electronic unit. Advantageously, as a result of the electronic unit being oriented and/or arranged on the cover unit, a short connection distance can be achieved for wiring the input unit and/or the output unit. For example, an LED or a display arranged directly on an electronic unit realized as a printed circuit board can be routed outward in a structurally simple manner, in particular to a side of the cover unit that faces away from the electronic unit.

Furthermore, it is proposed that the cover unit be designed to hold the electronic unit. It can thereby be ensured, advantageously, that, because there is little play on the electronic unit, there is little risk of damage to the electronic unit. Advantageously, an exchangeable electronic module can be provided. It is conceivable for the cover unit to have at least one holding element such as, for example, a holding groove, a holding lug, a holding pin, a hook, or other holding element considered appropriate by persons skilled in the art, for fixing the electronic unit in a form-fitting manner. Furthermore, it is conceivable for the cover unit to have at least one, in particular further, holding element such as, for example, a frictional surface, a rubber coating, a fluting, or a further holding element considered appropriate by persons skilled in the art, for fixing the electronic unit in a force-fitting manner. Advantageously, the electronic unit can be detached non-destructively from the cover unit without the use of any tools, in particular for the purpose of at least partly exchanging the electronic unit. It is conceivable for the cover unit to have a holding unit that can be actuated by a user, such as, for example, a latching unit, for detachably holding the electronic unit. A "latching unit" in this case is to be understood to mean, in particular, a unit having at least one latching element that, in the case of a fastening operation, is elastically deflected, in order subsequently to engage behind a corresponding latching element as a result of an inner tensioning force. Alternatively, it is conceivable for the electronic unit to be connected to the cover unit in an at least substantially non-detachable manner. An "at least substantially non-detachable connection" is to be understood here to mean, in particular, a connection of at least two elements that can be separated from each other only with the aid of parting tools such as, for example, a saw, in particular a mechanical saw, etc., and/or chemical parting means such as, for example, solvents, etc. It is conceivable for the electronic unit to be connected to the cover unit by means of an adhesive-bonded connection, riveting, welding, caulking, or other materially bonded connection considered appropriate by persons skilled in the art.

It is additionally proposed that the electronic module have at least one base unit, which is arranged on a side of the electronic unit that faces away from the cover unit, and which is designed to connect, in particular to receive, the cover unit, the electronic unit and/or the contacting unit. It is thereby possible, advantageously, to ensure that there is very little risk of damage to the electronic unit and/or to the contacting unit. It is possible, advantageously, to provide an electronic module that can be used in a flexible manner and that, in particular, can be connected to a multiplicity of devices. Advantageously, an exchangeable electronic module can be provided. It is conceivable for the base unit to be realized as a connection region, in particular as a receiving region, of a hand-held power tool, or as a separate unit having at least one connection region, in particular a receiving region, for the cover unit, the electronic unit and/or the contacting unit. Preferably, the base unit is designed to be detachably connected to the cover unit, the electronic unit and/or the contacting unit. Preferably, the cover unit has at least one fastening element, which is designed to detachably fix at least the cover unit to the base unit in a form-fitting and/or force-fitting manner. Preferably, the contacting unit of the electronic unit is designed to contact an electronic of the base unit, in particular for the purpose of transmitting data and/or transmitting electrical energy for operating at least the electronic unit. Preferably, the base unit has at least one baseplate. It is conceivable for the baseplate to be designed to be interchangeable and/or adaptable for the purpose of arranging the base unit on differing surfaces. Preferably, the base unit has at least one side wall. The side wall is preferably designed to surround at least the cover unit along a circumferential direction, in particular to fix the cover unit in a form-fitting manner. Alternatively, it is conceivable for the cover unit to be designed to encompass the side wall, in particular if there are fixing elements arranged on an outer side of the side wall. In the case of the electronic module being designed with a base unit that at least partly receives the cover unit, the electronic module preferably comprises a communication unit, in particular a transmit and/or receive unit, arranged in the base unit, at least for transmitting electrical energy and/or electronic data. The communication unit arranged in the base unit is preferably realized as an NFC communication unit. It is also conceivable, however, for the NFC communication unit to be of a different design, considered appropriate by persons skilled in the art. The communication unit has, in particular, at least one antenna element, for transmitting electrical energy and/or electronic data, such as, for example, a wire antenna, a wound wire antenna, or the like. The at least one antenna element of the communication unit is preferably arranged on a base of the base unit, in particular integrated into the base, such as, for example, encapsulated by a material of the base unit, or the like. It is also conceivable, however, for the antenna element to be fixed to the base, in particular by means of a separable connection, or the like. Preferably, the contacting unit has at least one contacting interface, which is designed to establish a connection between the electronic unit, arranged on the cover unit, and the communication unit, in particular the antenna element, arranged on the base, in particular when the cover unit has been arranged on the base unit. The base unit preferably forms a housing of the electronic module. Preferably, the contacting interface is realized as a mechanical contacting interface such as, for example, as a plug-in contact interface, as a contact tab, or the like. It is additionally conceivable for the communication unit, alternatively or additionally, to have at least one antenna element, which is integrated into the electronic unit, for example in the case of the at least one antenna element being designed as a printed circuit board antenna (PCB antenna) or the like. It is also conceivable for an energy storage unit of the electronic module and/or the electronic unit to be supplied with electrical energy by means of the at least one antenna element, for example by means of induction, or the like.

Furthermore, it is proposed that the electronic module have at least one energy storage-device receiving region, wherein the energy storage-device receiving region is arranged on a side of the electronic unit that faces away from the cover unit, in particular on the contacting unit. This makes it possible, advantageously, to provide an electronic module that can be used in a flexible manner and that, in particular, can be connected to a multiplicity of devices. Advantageously, an exchangeable electronic module can be provided. Preferably, the energy storage-device receiving region is designed to receive at least one energy storage device, in particular a battery, an accumulator, a pouch cell, a capacitor, a super-capacitor, or other energy storage device considered appropriate by persons skilled in the art, for the purpose of supplying energy at least to the electronic unit. If the electronic module comprises a base unit to which the cover unit is connected, the energy storage-device receiving unit is preferably arranged between the cover unit and the base unit. Preferably, the cover unit and the base unit surround the energy storage-device receiving unit, at least partly, in particular completely. It is conceivable for an energy storage-device fixing element of the electronic module, such as, for example a battery clip, a clamping holder, or other energy storage-device fixing element considered appropriate by persons skilled in the art to be arranged on the energy storage-device receiving region. Preferably, the electronic module has a layer structure. As viewed in at least one direction from the cover unit toward the contacting unit, the electronic unit is preferably arranged behind the cover unit. As viewed in at least one direction from the cover unit toward the contacting unit, the contacting unit is preferably arranged behind the electronic unit. As viewed in at least one direction from the cover unit toward the contacting unit, the energy storage-device receiving region is preferably arranged behind the contacting unit. As viewed in at least one direction from the cover unit toward the contacting unit, the base unit is preferably arranged, at least partly, behind the energy storage-device receiving region; in particular, a baseplate of the base unit is preferably arranged behind the energy storage-device receiving region.

Furthermore, it is proposed that the electronic module have at least one sealing unit, which is designed to seal the electronic unit and/or the contacting unit in a gas-tight, dust-tight and/or liquid-tight manner. It is thereby possible, advantageously, to ensure that there is little risk of damage to the electronic unit caused by the ingress of particles. Preferably, the sealing unit is arranged, at least partly, on the cover unit. Alternatively or additionally, it is conceivable for the sealing unit to be arranged, at least partly, on the electronic unit, on the contacting unit or on a base unit of the electronic module. It is conceivable for the sealing unit to have at least one sealing element such as, for example, an O-ring, a sealing lip, or other sealing element considered appropriate by persons skilled in the art. Furthermore, it is conceivable for the sealing to enclose the electronic unit and/or the contacting unit completely in a gas-tight, dust-tight and/or liquid-tight manner, in particular in the case of an encapsulated electronic unit and/or contacting unit.

It is additionally proposed that the electronic module have a centroid, wherein the centroid is arranged on a side of the electronic unit that faces away from the cover unit. It is thereby possible, advantageously, to ensure that there is little risk of damage to the electronic unit caused by shaking of the electronic module. This makes it possible, advantageously, to provide an electronic module that can be used in a flexible manner and that, in particular, can be connected to a multiplicity of devices. Advantageously, an exchangeable electronic module can be provided. A "centroid" of an object, in particular of the electronic module, is to be understood to mean, in particular, the mass-weighted mean of the positions of the mass points of the object, in particular of the electronic module. Preferably, the centroid is at a spatial distance of at least 1 mm, preferably at least 5 mm, particularly preferably at least 10 mm, from the cover unit. It is conceivable for the centroid to be arranged on an axis of symmetry, in particular on a point of intersection of a plurality of axes of symmetry, of the electronic module.

Furthermore, it is proposed that the electronic module have at least one damping unit, which is arranged on a side of the electronic unit that faces away from the cover unit, and which is designed to absorb a mechanical vibrational energy and/or to convert it into heat and/or to use it to operate the electronic unit. It is thereby possible, advantageously, to ensure that there is little risk of damage to the electronic unit caused by vibration. This makes it possible, advantageously, to provide an electronic module that can be used in a flexible manner and that, in particular, can be connected to a multiplicity of devices. Advantageously, an exchangeable electronic module can be provided. Preferably, the damping unit is designed to absorb a mechanical vibration energy of the energy storage device, of the contacting unit, of the electronic unit, of the cover unit and/or of a base unit, and/or to convert it into heat. Preferably the damping unit is arranged, at least partly, on an energy storage-device receiving region or on a base unit of the electronic module. Alternatively or additionally, it is conceivable for the damping unit to be arranged, at least partly, on the electronic unit, the cover unit and/or the contacting unit. It is conceivable for the damping unit to have at least one damping element such as, for example, a spring, a rubber cushion, a foam element, a gel cushion, or other damping element considered appropriate by persons skilled in the art. Furthermore, it is conceivable for the contacting unit and the damping unit to be realized, at least partly as a unit, in particular if the contacting unit has at least one springing contact element. It is conceivable for the damping unit to be realized, at least partly, as an energy harvesting unit, which is designed to use a mechanical vibrational energy to operate the electronic unit, in particular to convert it into electrical energy to operate the electronic unit.

It is conceivable, in an alternative design, for the electronic module to be realized such that it is independent of the cover unit. Preferably, in the alternative design, the electronic module comprises at least the electronic unit, at least the contacting unit, which is designed to contact an electrical energy source, and at least one receiving opening, via which a functional component can be inserted between two components of the electronic module. It is thereby possible, advantageously, to ensure that there is little risk of damage to the electronic unit during mounting and/or removal of a functional component. This makes it possible, advantageously, to provide an electronic module that can be used in a flexible manner and that, in particular, can be connected to a multiplicity of devices. Advantageously, an exchangeable electronic module can be provided. Preferably, the receiving opening is arranged on the cover unit. Alternatively or additionally, it is conceivable for a, in particular further, receiving opening, to be arranged on a base unit of the electronic module. It is conceivable for the receiving opening and a, in particular further, receiving opening of a base unit of the electronic module to be arranged on the electronic module in such a manner that a functional component can be inserted between two components of the electronic module, through the receiving opening and the, in particular further, receiving opening of the base unit of the electronic module. A "functional component" is to be understood to mean, in particular, an electronic component or an electronic assembly such as, for example, a sensor unit or a storage module, by which a functionality of the electronic module can advantageously be influenced, in particular expanded. It is conceivable that the functional component can be removed through the receiving opening and/or a, in particular further, receiving opening of a base unit of the electronic module. Furthermore, it is conceivable for the electronic unit to have at least one connection interface, for electrically connecting the functional component to the electronic unit, in particular in a region of the electronic unit that is opposite the receiving opening.

It is additionally proposed that the receiving opening be realized as a receiving slot. It is thereby possible, advantageously, to ensure that there is little risk of damage to the electronic unit as a result of physical contact on the electronic unit. This makes it possible, advantageously, to provide an electronic module that can be used in a flexible manner and that, in particular, can be connected to a multiplicity of devices. Advantageously, an exchangeable electronic module can be provided. A "receiving slot" is to be understood to mean, in particular, a receiving opening having a main spatial extent that is at least 100%, preferably at least 200%, and particularly preferably 500% greater than a spatial width of the receiving opening. Advantageously, the receiving slot has an at least substantially straight course along the direction of main spatial extent. "At least substantially" is to be understood to mean, in particular, that a deviation from a predefined value is, in particular, less than 25%, preferably less than 10%, and particularly preferably less than 5% of the predefined value. Particularly preferably, the receiving slot, or a receiving recess adjoining the receiving slot, is at least substantially parallel to a plane of main extent of the electronic module, in particular a bottom surface or a top surface of the electronic module. It is conceivable that there is/are at least one insertion frame and/or at least one closure element arranged on the electronic unit that can be inserted in the receiving slot. The insertion frame is preferably designed to carry, receive and/or protect the electronic unit. The closure element is preferably designed to close the receiving slot outwardly when the electronic unit has been inserted in the receiving slot. It is conceivable that, in addition, there is at least one sealing element arranged on the closure element, for sealing the receiving slot when the electronic unit has been inserted in the receiving slot.

Additionally proposed is a system having at least one hand-held power tool and at least one electronic module according to the disclosure. Preferably, the hand-held power tool has at least one receiving region, for receiving the electronic module according to the disclosure. Preferably, the hand-held power tool has at least one contact means, arranged on the receiving region, for electrically contacting the electronic module according to the disclosure, in particular the contacting unit of the electronic module according to the disclosure. Particularly preferably, data and/or electrical energy can be transmitted between the hand-held power tool and the electronic module according to the disclosure, in particular arranged in the receiving region, in particular by means of the contacting unit and/or by means of a communication unit of the electronic module according to the disclosure, for the purpose of operating the electronic module according to the disclosure. Preferably, the electronic module according to the disclosure can be detachably fastened in the receiving region.

It is additionally proposed that the system comprise at least one further electronic module, which has at least one cover unit and an electronic unit arranged thereon, wherein the further electronic module is realized such that it differs from the electronic module, at least in respect of the electronic unit and/or the cover unit, and can be arranged, as an alternative to the electronic module, on the hand-held power tool. Advantageously, by means of the design according to the disclosure, a modular structure of the electronic module can be realized. Preferably, an upgrade function and/or servicing function of the electronic module can be realized by simple structural design means. Advantageously, by exchange of cover units, it is made possible for the electronic module to be adaptable to differing fields of application.

The electronic module according to the disclosure and/or the system according to the disclosure is/are not intended in this case to be limited to the application and embodiment described above. In particular, for the purpose of fulfilling a functionality described herein, the electronic module according to the disclosure and/or the system according to the disclosure may have a number of individual elements, components and units that differs from a number stated herein. Moreover, in the case of the value ranges specified in this disclosure, values lying within the stated limits are also to be deemed as having been disclosed and applicable in any manner.

BRIEF DESCRIPTION OF THE DRAWINGS

Further advantages are disclosed by the following description of the drawings. Four exemplary embodiments are represented in the drawings. The drawings, the description and the claims contain numerous features in combination. Persons skilled in the art will also expediently consider the features individually and combine them to create appropriate further combinations. There are shown:

DETAILED DESCRIPTION

Figure 1A:
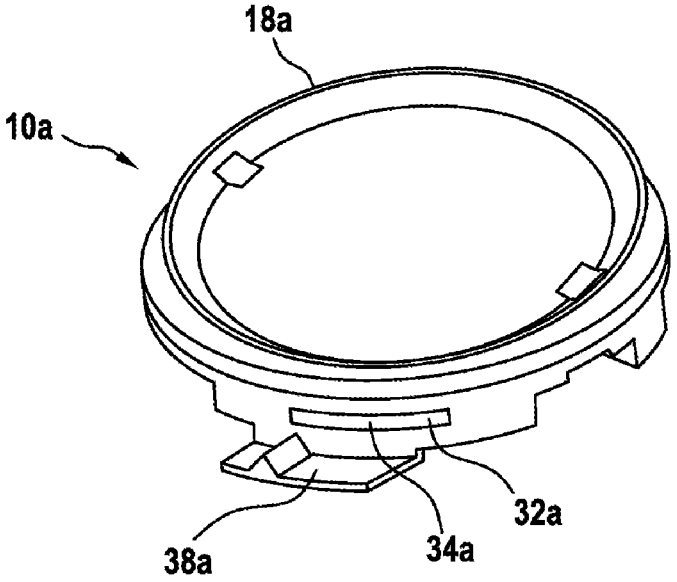
FIG. 1*a* a perspective top view of an electronic module, in a schematic representation, FIG. 1*b* a perspective sectional view of the electronic module from FIG. 1*a*, in a schematic representation, FIG. 2*a* a perspective top view of an alternative electronic module, in a schematic representation, FIG. 2*b* a perspective sectional view of the electronic module from FIG. 2*a*, in a schematic representation, FIG. 3 a perspective top view of a further alternative electronic module, in a schematic representation, FIG. 4*a* a perspective top view of a further alternative electronic module of a system, in a schematic representation, and FIG. 4*b* a system comprising the electronic module from FIG. 4*a* and a hand-held power tool, as well as a further electronic module, which is realized such that it differs from the electronic module from FIG. 4*a*, in a schematic representation.
Figure 1B:
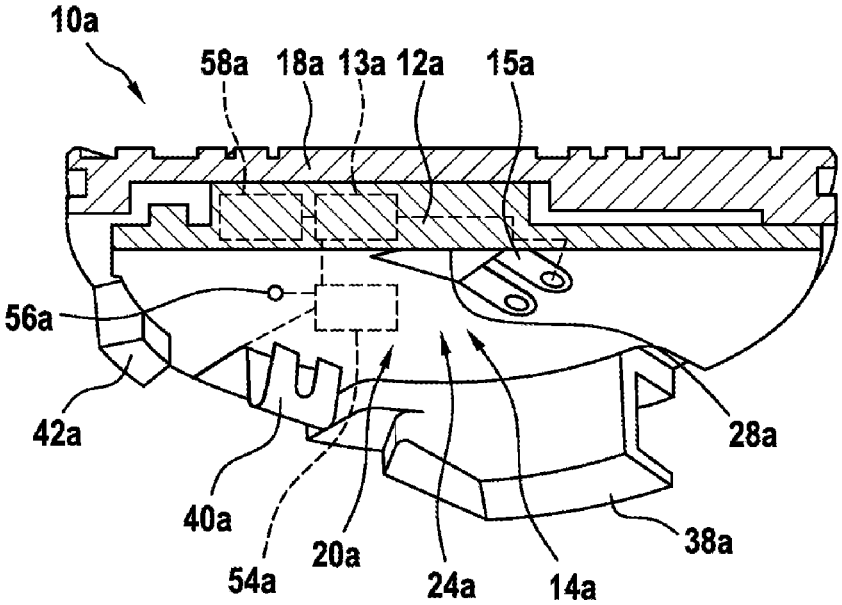

An exemplary embodiment of the electronic module 10*a* is represented in FIGS. 1*a* and 1*b*. The electronic module 10*a* comprises an electronic unit 12*a*. The electronic module 10*a*, in particular the electronic unit 12*a*, has a sensor unit 58*a* for sensing an operator-specific characteristic and/or a characteristic that is specific to a hand-held power tool. The electronic module 10*a* comprises a computing unit 13*a*. The computing unit 13*a* is designed to process data of the sensor unit 58*a*, to process user inputs of an input unit, to exchange data with an output unit and/or a communication unit 54*a*, to control an external unit, in particular a hand-held power tool, and/or to manage energy of an electrical energy source.

The electronic module 10*a* comprises a contacting unit 14*a*. The contacting unit 14*a* is designed to contact an electrical energy source. The contacting unit 14*a* comprises a contacting element 15*a*, realized as a spring contact, which is designed to contact an electrical energy storage device. The contacting unit 14*a* comprises a further contacting element 40*a*, which is designed to contact a base unit, in particular of a hand-held power tool (not represented here). The contacting unit 14*a* comprises an additional contacting element 56*a*, which is designed to wirelessly contact an electrical energy source and/or for wireless data transmission.

The electronic module 10*a* comprises a cover unit 18*a*. On a side that faces away from the electronic unit 12*a*, the cover unit 18*a* has a closed surface, which extends over the entire electronic unit 12*a*. The electronic module 10*a* has a fastening element 38*a*. The fastening element 38*a* is arranged on the cover unit 18*a*. The fastening element 38*a* is designed to detachably fasten the electronic module 10*a* to a base unit, in particular to a hand-held power tool or to a base unit realized as a housing of the electronic module 10*a*. The contacting unit 14*a* is arranged on a side 20*a* of the electronic unit 12*a* that faces away from the cover unit 18*a*. The cover unit 18*a* is designed to hold the electronic unit 12*a*. The cover unit 18*a* has a holding element 412*a* for holding the electronic unit 12*a*. The holding element 42*a* fixes the electronic unit 12*a* to the cover unit 18*a* in a form-fitting manner.

The electronic module 10*a*, in particular the electronic unit 12*a*, has a communication unit 54*a* for wirelessly exchanging data with an external unit, in particular with a hand-held power tool. The communication unit 54*a* is preferably realized as a wireless communication unit such as, for example, an NFC communication unit, as a Bluetooth communication unit, or the like. The communication unit 54*a* has a contacting element 56*a* for supplying the electronic module 10*a* with electrical energy, which may be provided, in particular, by the external unit. The contacting element 56*a* is designed for wireless connection to the external unit. The communication unit 54*a* is realized partly as a unit with the contacting unit 14*a*.

The electronic module 10*a* has an energy storage-device receiving region 24*a*. The energy storage-device receiving region 24*a* is arranged on a side 20*a* of the electronic unit 12*a* that faces away from the cover unit 18*a*. The energy storage-device receiving region 24*a* is arranged such that it is adjacent to the contacting unit 14*a*.

The electronic module 10*a* has a layer structure. As viewed in a direction from the cover unit 18*a* toward the contacting unit 14*a*, the electronic unit 12*a* is arranged behind the cover unit 18*a*. As viewed in the direction from the cover unit 18*a* toward the contacting unit 14*a*, the contacting unit 14*a* is arranged behind the electronic unit 12*a*. As viewed in the direction from the cover unit 18*a* toward the contacting unit 14*a*, the energy storage-device receiving region 24*a* is arranged behind the contacting unit 14*a*.

The electronic module 10*a* has a centroid 28*a*. The centroid 28*a* is arranged on a side 20*a* of the electronic unit 12*a* that faces away from the cover unit 18*a*.

The electronic module 10*a* has a receiving opening 32*a*, via which a functional component can be inserted between components of the electronic module 10*a*. The receiving opening 32*a* is realized as a receiving slot 34*a*.

FIGS. 2*a* to 4*b* show three further exemplary embodiments of the disclosure. The descriptions that follow are limited substantially to the differences between the exemplary embodiments and, in respect of components, features and functions that remain the same, reference may be made to the description of the other exemplary embodiments, in particular of FIGS. 1*a* and 1*b*. To differentiate the exemplary embodiments, the letter a in the reference numerals of the exemplary embodiment of FIGS. 1*a* and 1*b* is replaced by the letters b, c and d in the reference numerals of the exemplary embodiments of FIGS. 2*a* to 4*b*. In respect of components having the same designation, in particular with respect to components denoted by the same reference numerals, reference may also be made, in principle, to the drawings and/or the description of the other exemplary embodiments, in particular of FIGS. 1*a* and 1*b*.

Figure 2A:
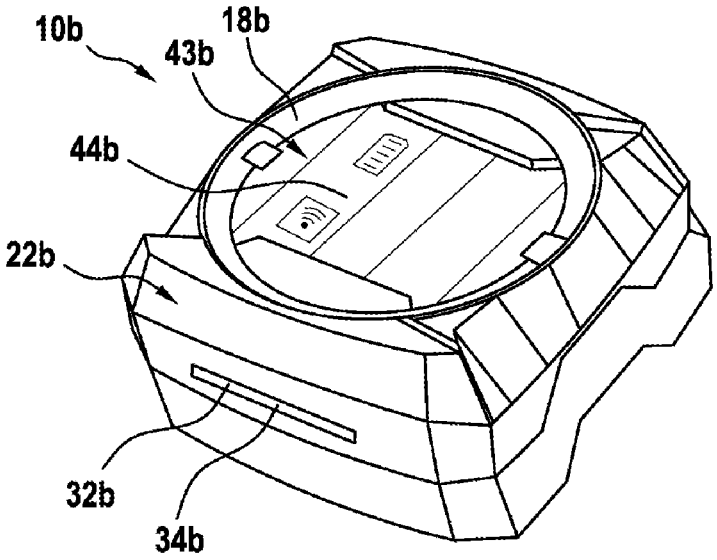
Figure 2B:
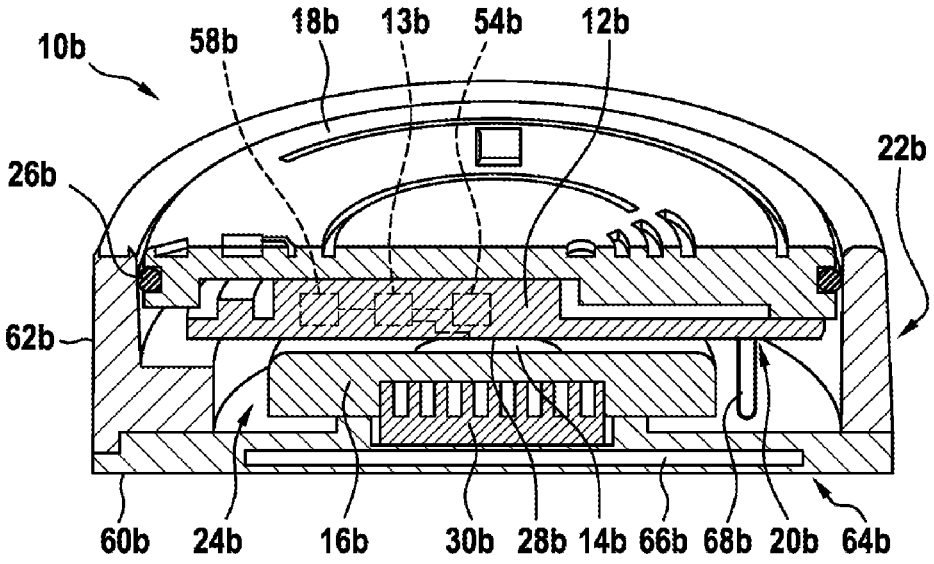

A further exemplary embodiment of an electronic module 10*b* is represented in FIGS. 2*a* and 2*b*. The electronic module 10*b* comprises an electronic unit 12*b*. The electronic module 10*b* comprises a contacting unit 14*b*. The contacting unit 14*b* is designed to contact an electrical energy source 16*b*. The electronic module 10*b* comprises a cover unit 18*b*. The contacting unit 14*b* is arranged on a side 20*b* of the electronic unit 12*b* that faces away from the cover unit 18*b*.

The electronic module 10*b* has a base unit 22*b*, arranged on a side 20*b* of the electronic unit 12*b* that faces away from the cover unit 18*b*. The base unit 22*b* is designed to receive the cover unit 18*b*. The base unit 22*b* is designed to receive the electronic unit 12*b*. The base unit 22*b* forms, in particular, a housing of the electronic module 10*b*. The base unit 22*b* is designed to receive the contacting unit 14*b*. The base unit 22*b* has a baseplate 60*b*. The baseplate 60*b* is arranged opposite the cover unit 18*b*. The base unit 22*b* has a side wall 62*b*. The side wall 62*b* is designed to surround the cover unit 18*b* along a circumferential direction, in particular to fix the cover unit 18*b* in a form-fitting manner.

The electronic module 10*b* has a layer structure. As viewed in a direction from the cover unit 18*b* toward the contacting unit 14*b*, the electronic unit 12*b* is arranged behind the cover unit 18*b*. As viewed in the direction from the cover unit 18*b* toward the contacting unit 14*b*, the contacting unit 14*b* is arranged behind the electronic unit 12*b*. As viewed in the direction from the cover unit 18*b* toward the contacting unit 14*b*, an energy storage-device receiving region 24*b* is arranged behind the contacting unit 14*b*. As viewed in the direction from the cover unit 18*b* toward the contacting unit 14*b*, the base unit 22*b* is arranged partly behind the energy storage-device receiving region 24*b*. As viewed in the direction from the cover unit 18*b* toward the contacting unit 14*b*, the baseplate 60*b* of the base unit 22*b* is arranged behind the energy storage-device receiving region 24*b*.

The electronic module 10*b* has an output unit 43*b*, for outputting optical, acoustic and/or haptic information. The output unit 43*b* has an output element 44*b*, realized as an indicator panel. The electronic module 10*b* has an electrical energy source 16*b*. The electrical energy source 16*b* is realized as an energy storage device, in particular as a battery.

The electronic module 10*b* has a sealing unit 26*b*. The sealing unit 26*b* is designed to seal the electronic unit 12*b* in a gas-tight manner. The sealing unit 26*b* is designed to seal the contacting unit 14*b* in a gas-tight manner. The sealing unit 26*b* is designed to seal the electronic unit 12*b* in a dust-tight manner. The sealing unit 26*b* is designed to seal the contacting unit 14*b* in a dust-tight manner. The sealing unit 26*b* is designed to seal the electronic unit 12*b* in a liquid-tight manner. The sealing unit 26*b* is designed to seal the contacting unit 14*b* in a liquid-tight manner. The sealing unit 26*b* is realized as a circumferential sealing rubber, in particular as an O-ring. The cover unit 18*b* has a circumferential groove for fixing the sealing rubber in a form-fitting manner.

The electronic module 10*b* has a damping unit 30*b*. The damping unit 30*b* is arranged on a side 20*b* of the electronic unit 12*b* that faces away from the cover unit 18*b*. The damping unit 30*b* is designed to absorb a mechanical vibrational energy and/or to convert it into heat. The damping unit 30*b* is designed to damp a mechanical vibration of the electrical energy source 16*b*, of the electronic unit 12*b*, of the cover unit 18*b* and/or the contacting unit 14*b*. The damping unit 30*b* is realized as a foam cushion. It is also conceivable, however, for the damping unit 30*b* to be of a different design, considered appropriate by persons skilled in the art, such as, for example, designed as a rubber buffer, as a caoutchouc insert, or the like.

The electronic module 10*b* comprises a further communication unit 64*b*, in particular a transmit and/or receive unit, arranged in the base unit 22*b*, at least for transmitting electrical energy and/or electronic data. The further communication unit 64*b* arranged in the base unit 22*b* is preferably realized as an NFC communication unit. It is also conceivable, however, for the further communication unit 64*b* to be of another design, considered appropriate by persons skilled in the art. The further communication unit

64*b* has, in particular, at least one antenna element 66*b*, for transmitting electrical energy and/or electronic data, such as, for example, a wire antenna, a wound wire antenna, or the like. The at least one antenna element 66*b* of the further communication unit 64*b* is preferably arranged on a base of the base unit 22*b*, in particular integrated into the base, such as, for example, encapsulated by a material of the base unit 22*b*, or the like. It is also conceivable, however, for the antenna element 66*b* to be fixed to the base, in particular by means of a separable connection, or the like. Preferably, the antenna element 66*b* is realized as a wound wire antenna that is integrated into the basic housing 22*b*. It is also conceivable, however, that the antenna element 66*b* is arranged, in particular is fixed, to the base unit 22*b*, in particular to the base of the base unit 22*b*, by means of a multi-component injection molding method, or the like, and/or by means of a form-fitting and/or force-fitting connection.

Preferably, the contacting unit 14*b* has at least one contacting interface 68*b*, which is designed to establish a connection between the electronic unit 12*b*, arranged on the cover unit 18*b*, and the further communication unit 64*b*, in particular the antenna element 66*b*, arranged on the base unit 22*b*, in particular on the base of the base unit 22*b*, in particular when the cover unit 18*b* has been arranged on the base unit 22*b*. The base unit 22*b* preferably forms a housing of the electronic module 10*b*. Preferably, the contacting interface 68*b* is realized as a mechanical contacting interface, such as, for example, as a plug-in contact interface, as a contact tab, or the like. It is conceivable for the electronic unit 12*b* arranged on the cover unit 18*b* to be realized with at least two differing contact surfaces. The contact surfaces may be arranged in any manner on the downward-facing side. Advantageously, the contact surfaces are located in a lateral region of the cover unit 18*b*, in order to realize an advantageous routing past an energy source, in particular a battery or accumulator, arranged in the base unit 22*b*, so as to reduce the likelihood of a short circuit. It is also conceivable for the base unit 22*b* to have at least two contact springs, which are connected to the antenna element. The contact springs are designed to contact the electronic unit 12*b*, in particular counter-contact springs realized so as to correspond to contact springs, when the cover unit 18*b* is arranged on the base unit 22*b*. It is also conceivable for the contacting interface 68*b* to be realized so as to be integral with a fixing interface of the electronic module 10*b*. The fixing interface of the electronic module 10*b* is designed, at least, to fix the cover unit 18*b* to the base unit 22*b* by means of a materially bonded and/or force-fitting connection, such as, for example, in the manner of a bayonet closure, or the like. A different design and/or arrangement of the contacting interface, considered appropriate by persons skilled in the art, is/are likewise conceivable.

Figure 3:
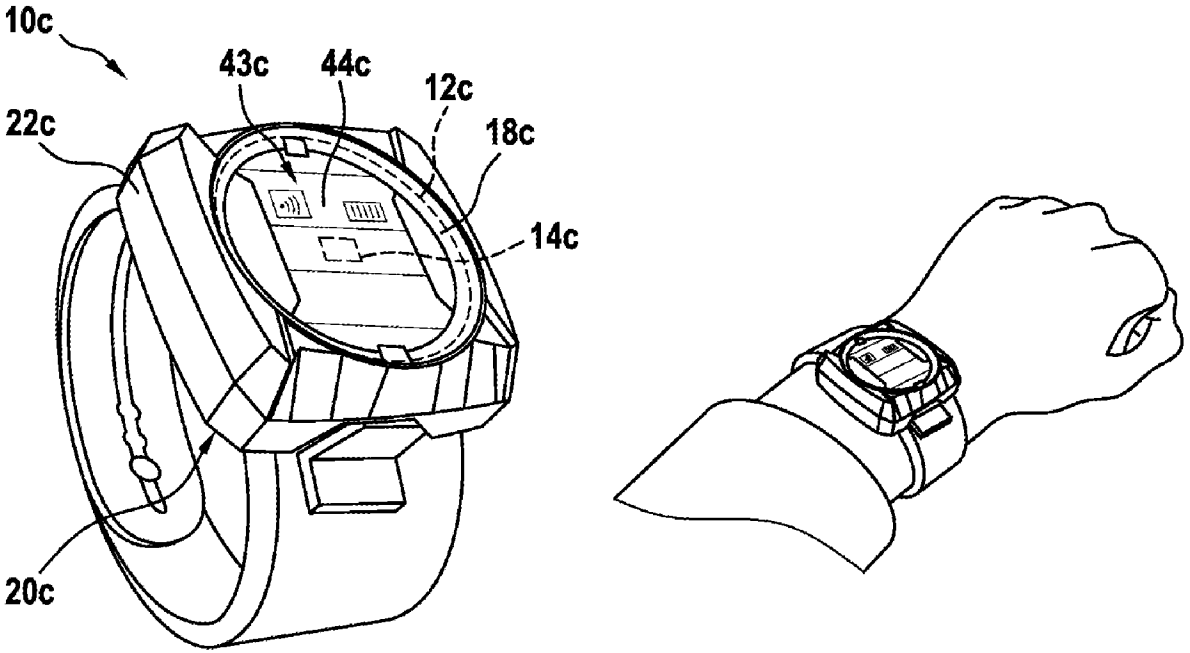

A further exemplary embodiment of the electronic module 10*c* is represented in FIG. 3. The electronic module 10*c* comprises an electronic unit 12*c*. The electronic module 10*c* comprises a contacting unit 14*c*. The contacting unit 14*c* is designed to contact an electrical energy source. The electronic module 10*c* comprises a cover unit 18*c*. The contacting unit 14*c* is provided on a side of the electronic unit 12*c* that faces away from the cover unit 18*c*. The electronic unit 12*c* of the electronic module 10*c* represented in FIG. 3 is of a design that is at least substantially similar to that of the electronic unit 12*a* of the electronic module 10*a* represented in FIGS. 1*a* and 1*b*, or that of the electronic unit 12*b* of the electronic module 10*b* represented in FIGS. 2*a* and 2*b*. The electronic module 10*c* comprises a base unit 22*c*. The base unit 22*c* is realized as an arm-band, having a receiving region for the cover unit 18*c*.

Figure 4A:
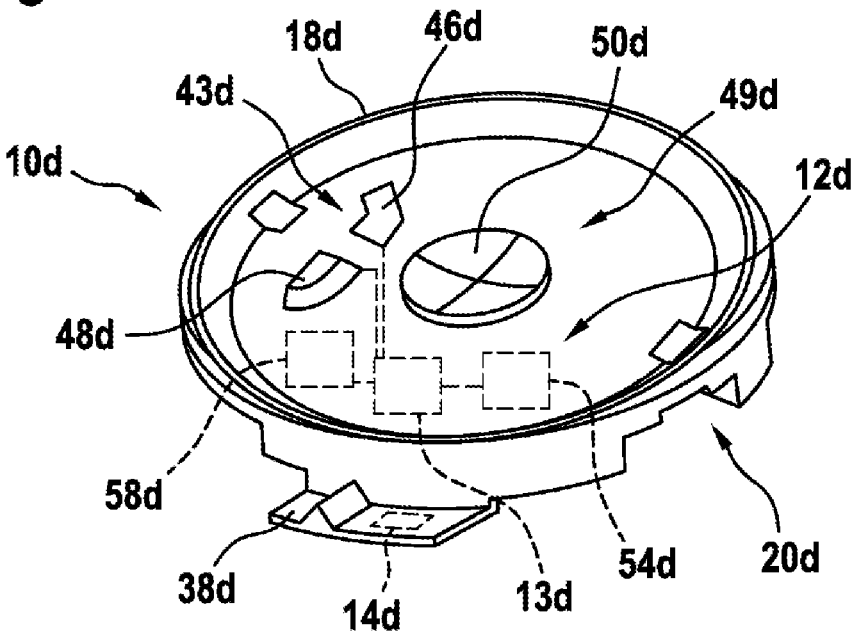
Figure 4B:
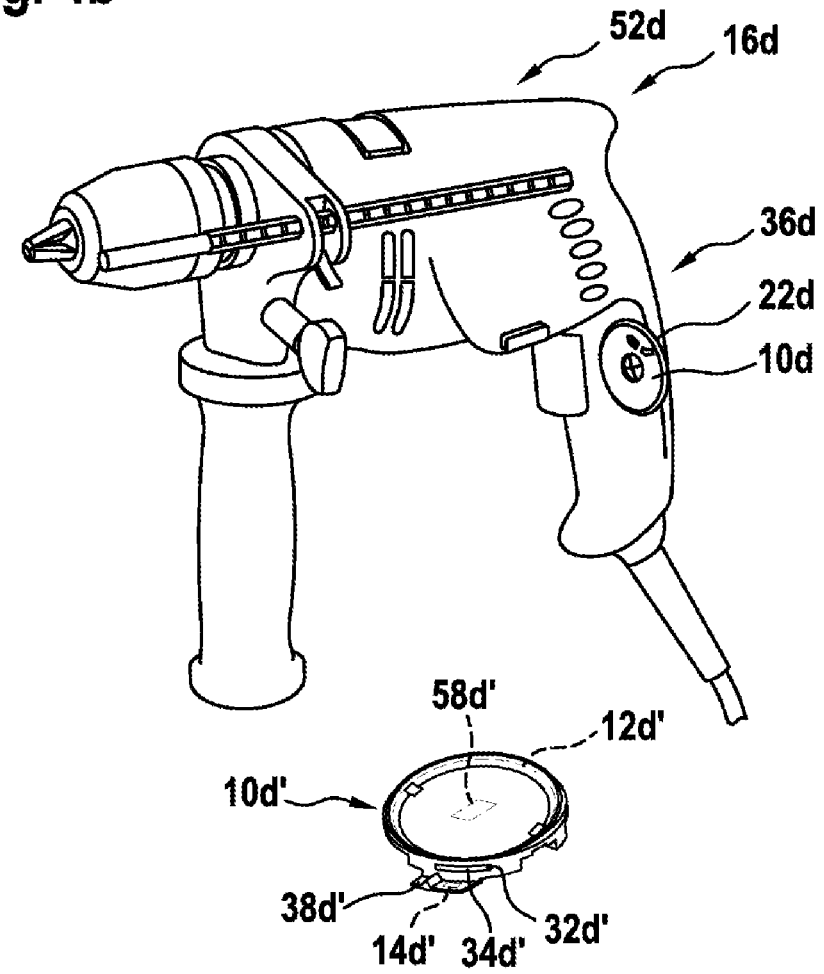

Represented in FIGS. 4*a* and 4*b* is an exemplary embodiment of a system 52*d* having an electronic module 10*d* and a hand-held power tool 36*d*. The hand-held power tool 36*d* of the system 52*d* has a base unit 22*d*, realized as a receiving region for the electronic module 10*d*. The hand-held power tool 36*d* has a contact means, not represented in greater detail, arranged on the receiving region, for electrically contacting a contacting unit 14*d* of the electronic module 10*d*. By means of the contact means and the contacting unit 14*d*, data and/or electrical energy can be transmitted between the hand-held power tool 36*d* and the electronic module 10*d*, for the purpose of operating the electronic module 10*d*. The electronic module 10*d* is detachably fastened in the base unit 22*d*, which is realized as a receiving region for the electronic module 10*d*. The electronic module 10*d* is held on the base unit 22*d* in a form-fitting manner by means of a fastening element 38*d*. The fastening element 38*d* is arranged on the cover unit 18*d*, in particular realized integrally with the cover unit 18*d*. It is conceivable for the contacting unit 14*d* to be arranged, at least partly, on the fastening element 38*d*. Advantageously, when the electronic module 10*d* is arranged on the hand-held power tool 36*d*, a contact can be realized, for transmitting electrical energy and/or for transmitting electronic data between the hand-held power tool 36*d* and the electronic module 10*d*.

The electronic module 10*d*, in particular the electronic unit 12*d* of the electronic module 10*d*, comprises an output unit 43*d*. The output unit 43*d* comprises output elements 46*d*, 48*d*, realized as light-emitting diodes. It is also conceivable, however, for the output unit 43*d*, alternatively or additionally, to have at least one output element that is realized as a display, as a loudspeaker, or the like.

The electronic module 10*d*, in particular the electronic unit 12*d*, comprises an input unit 49*d*. The input unit 49*d* comprises an operating element 50*d*, realized as an operating button or operating switch. It is also conceivable, however, for the input unit 49*d*, alternatively or additionally, to have at least one operating element that is realized as a touch-sensitive or proximity-sensitive operating element, or the like.

The system comprises at least one further electronic module 10*d*', which has at least one cover unit 18*d*', and an electronic unit 12*d* arranged thereon, the further electronic module 10*d*' being realized such that it differs from the electronic module 10*d*, at least in respect of the electronic unit 12*d* and/or the cover unit 18*d* of the electronic module 10*d*, and can be arranged, as an alternative to the electronic module 10*d*, on the hand-held power tool 36*d*. The further electronic module 10*d*' preferably is of a design that it at least substantially similar to that of the electronic module 10*a* represented in FIGS. 1*a* and 1*b*.

The invention claimed is:

1. An electronic module comprising:

at least one electronic unit, said at least one electronic unit including at least one of a transistor, a microprocessor and a computing unit;

at least one electronic functional component including at least one of a sensor unit and a storage module;

at least one contacting unit designed to at least one of (a) contact an electrical energy source and (b) transmit electronic data; and at least one receiving opening configured such that the electronic functional component is insertable through the at least one receiving opening and insertable between the electronic unit and the contacting unit.

2. The electronic module of claim 1, further comprising:
at least one cover unit,
wherein the at least one contacting unit is arranged on a side of the electronic unit that faces away from the cover unit.

3. The electronic module as claimed in claim 2, wherein the cover unit is designed to hold the electronic unit.

4. The electronic module as claimed in claim 2, further comprising:
at least one base unit arranged on the side of the electronic unit that faces away from the cover unit, the at least one base unit configured to engage the at least one cover unit to contain the electronic unit and the contacting unit.

5. The electronic module as claimed in claim 4, wherein the at least one base unit is designed to receive the at least one of the cover unit, the electronic unit, and the contacting unit.

6. The electronic module as claimed in claim 2, further comprising:
at least one energy storage-device receiving region arranged on the side of the electronic unit that faces away from the cover unit.

7. The electronic module as claimed in claim 6, wherein the at least one energy storage-device receiving region is arranged on the contacting unit.

8. The electronic module as claimed in claim 2, further comprising:
at least one sealing unit designed to seal at least one of the electronic unit and the contacting unit in at least one of a gas-tight, a dust-tight, and a liquid-tight manner.

9. The electronic module as claimed in claim 2, wherein a centroid of the electronic module is arranged on the side of the electronic unit that faces away from the cover unit.

10. The electronic module as claimed in claim 2, further comprising:
at least one damping unit arranged on the side of the electronic unit that faces away from the cover unit, the at least one damping unit designed to at least one of absorb a mechanical vibrational energy and convert the mechanical vibrational energy into heat.

11. The electronic module as claimed in claim 2, wherein the electronic module is arranged on a hand-held power tool.

12. The electronic module as claimed in claim 1, wherein the receiving opening includes a receiving slot.

13. The electronic module as claimed in claim 1, wherein the electronic module is arranged on a hand-held power tool.

14. A system comprising:
at least one hand-held power tool; and
at least one first electronic module including;
at least one first electronic unit, said at least one first electronic unit including at least one of a transistor, a microprocessor and a computing unit;
at least one electronic functional component including at least one of a sensor unit and a storage module;
at least one first contacting unit designed to at least one of (a) contact an electrical energy source and (b) transmit electronic data;
at least one receiving opening configured such that the electronic functional component is insertable through the at least one receiving opening between two components of the first electronic module; and
at least one first cover unit,
wherein the at least one first contacting unit is arranged on a side of the at least one first electronic unit that faces away from the at least one first cover unit; and
at least one second electronic module including;
at least one second cover unit; and
a second electronic unit arranged on the at least one second cover unit, said second electronic unit including at least one of a transistor, a microprocessor and a computing unit,
wherein the second electronic module is configured such that the second electronic module differs from the first electronic module in such a way that at least one of the second electronic unit and the second cover unit differs from at least one of the respective first electronic unit and the first cover unit, and
wherein the second electronic module is configured to be arranged, on the hand-held power tool as an alternative to the first electronic module.

15. A system comprising:
at least one hand-held power tool; and
at least one first electronic module comprising:
at least one first electronic unit, said at least one first electronic unit including at least one of a transistor, a microprocessor and a computing unit;
at least one electronic functional component including at least one of a sensor unit and a storage module;
at least one first contacting unit designed to at least one of (a) contact an electrical energy source and (b) transmit electronic data; and
at least one receiving opening configured such that the electronic functional component is insertable through the at least one receiving opening and insertable between the electronic unit and the contacting unit.

16. The system of claim 15, wherein the at least one first electronic module further comprises:
at least one first cover unit,
wherein the at least one first contacting unit is arranged on a side of the at least one first electronic unit that faces away from the at least one first cover unit.

17. An electronic module comprising:
at least one electronic unit having at least one contacting unit configured to at least one of contact an electrical energy source and transmit electronic data;
at least one cover unit configured to hold the electronic unit, wherein the contacting unit is arranged on a side of the electronic unit that faces away from the cover unit; and
at least one damping unit arranged on said side of the electronic unit and including an energy harvesting unit configured to convert mechanical vibrational energy from vibration of the electronic module into electrical energy for operating the electronic unit.

18. The electronic module of claim 17, further comprising a base unit arranged on said side of said electronic unit, said base unit configured to engage the cover unit to contain the electronic unit, the contacting unit and the damping unit.

19. The electronic module of claim 18, further comprising a sealing unit disposed between said base unit and said at least one cover unit.

20. The electronic module of claim 17, further comprising at least one energy storage device receiving region between said contacting unit and said at least one damping unit, said at least one region configured to receive an energy storage device.

* * * * *